US008517701B2

(12) United States Patent
Tanigawa

(10) Patent No.: US 8,517,701 B2
(45) Date of Patent: Aug. 27, 2013

(54) MULTISTAGE VACUUM PUMP

(75) Inventor: Shiro Tanigawa, Kanagawa (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 13/479,711

(22) Filed: May 24, 2012

(65) Prior Publication Data

US 2012/0257961 A1 Oct. 11, 2012

Related U.S. Application Data

(63) Continuation of application No. PCT/JP2010/071706, filed on Dec. 3, 2010.

(30) Foreign Application Priority Data

Dec. 24, 2009 (JP) ..... 2009-292385

(51) Int. Cl.
*F01C 1/30* (2006.01)

(52) U.S. Cl.
USPC ..... 418/9; 418/150; 418/206.1; 418/206.5

(58) Field of Classification Search
USPC ..... 418/9, 10, 5, 7, 150, 205, 201.1, 418/201.3, 206.1, 206.5, 206.6, 199, 200; 417/249
See application file for complete search history.

(56) References Cited

U.S. PATENT DOCUMENTS 5,401,151 A * 3/1995 Allen ..... 418/191
5,518,382 A * 5/1996 Gennaro ..... 418/188
5,674,051 A * 10/1997 Maruyama ..... 417/3
8,308,458 B2 * 11/2012 Kettlewell et al. ..... 418/19
2003/0103847 A1 * 6/2003 Nonaka et al. ..... 417/203
2008/0080984 A1 4/2008 Tanigawa et al.
2008/0226480 A1 * 9/2008 Ferran et al. ..... 418/5

FOREIGN PATENT DOCUMENTS

JP 54-182923 U 12/1979
JP 62-71392 U 5/1987

(Continued)

OTHER PUBLICATIONS

International Search Report Issued in PCT/JP2010/071706 dated Aug. 23, 2012.

(Continued)

*Primary Examiner* — Thomas Denion
*Assistant Examiner* — Kelsey Gambrel
(74) *Attorney, Agent, or Firm* — Rossi, Kimms & McDowell LLP

(57) ABSTRACT

A multistage vacuum pump has a pair of rotors disposed in each of pump chambers connected in stages. As the rotors rotate while intermeshing, a suctioned gas is compressed and discharged, angles of the rotors are adjusted so that a phase angle $\Delta\theta$ of the rotors of adjacent pump chambers relative to a rotation angle C of the rotors during a single cycle of the pump chambers from intake to discharge and the number of stages S of the rotors satisfies $\Delta\theta \leqq C/S$. When a rotor angle is $\phi 1$, an mth stage rotor angle is $\phi m$, and an nth stage rotor angle is $\phi n$ in order from an upstream side of a gas flow direction, relationships of $\phi 1 < \phi m \leqq \phi n$ and $\phi 1 < \phi n$, where n and m are natural numbers and n>m, are satisfied.

6 Claims, 7 Drawing Sheets

(56) References Cited

FOREIGN PATENT DOCUMENTS

| | | | |
|---|---|---|---|
| JP | 63-75377 | A | 4/1988 |
| JP | 64-000383 | A | 1/1989 |
| JP | 3-52392 | U | 5/1991 |
| JP | 6-336990 | A | 12/1994 |
| JP | 6336990 | * | 12/1994 |
| JP | 2002130166 | A | 5/2002 |
| JP | 2008088879 | A | 4/2008 |

OTHER PUBLICATIONS

International Search Report Issued in PCT/JP2010/071706 dated Feb. 15, 2011.

* cited by examiner (A)

(B)

(A)

(B)

Prior Art

Prior Art

MULTISTAGE VACUUM PUMP

This is a bypass continuation of and claims benefit to PCT/JP2010/071706, filed Dec. 3, 2010, pending, which in turn claims benefit to JP 2009-292385, filed Dec. 24, 2009, the content of which is incorporated herein by reference.

TECHNICAL FIELD

The present invention relates to a multistage vacuum pump in which a plurality of pump chambers are connected in series and by rotating a pair of rotors disposed in each pump chamber, a volume of a compression space is varied such that a suctioned gas is compressed in sequence from an upper stage side toward a lower stage side.

BACKGROUND ART

A multistage vacuum pump in which a plurality of pump chambers are connected in series is widely used conventionally.

As an example, FIG. 10 shows an internal structure of a multistage vacuum pump. In this vacuum pump, a shaft 71 and a shaft 72 are disposed in parallel inside a housing, not shown in the drawing. Rotors 51 to 54 attached to the shaft 71 and rotors 61 to 64 attached to the shaft 72 form respective pairs which rotate without contacting each other in pump chambers partitioned by partition plates, not shown in the drawing.

In the drawing, second stage rotors 52, 62, third stage rotors 53, 63, and fourth stage rotors 54, 64 from an upstream side of a gas flow direction are claw type rotors. With claw type rotors, a male rotor and a female rotor rotate in opposite directions to each other such that gas suctioned through a suction port is compressed by variation in a volume of an enclosed space between the two rotors and the housing. Thus, a vacuum subject space connected to the suction port is set in a vacuum state. A vacuum pump using claw type rotors is disclosed in Patent Document 1 (Japanese Patent Application Publication No. 2008-88879), for example.

FIG. 11 is a view illustrating intake, compression, and discharge processes of a conventional multistage vacuum pump. As shown in FIG. 11A, at intake and discharge end points, an intake port 73 and a discharge port 74 are closed by the male rotor 52 and the female rotor 62, but when the two rotors 52, 62 are rotated further, as shown in FIG. 11B, the intake port 73 is opened such that gas is taken in and a compression pocket 75 is compressed. When the discharge port 74 is opened, the compressed gas is discharged and transferred to a subsequent stage pump chamber. When the two rotors 52, 62 rotate further following the completion of discharge, as shown in FIG. 11C, intake starts again, followed by the compression process.

In this type of multistage vacuum pump, the gas compressed in a previous stage compression pocket is transferred to the subsequent stage through a gas passage that opens as the rotors rotate. Timings of the compression process and this opening operation are set mainly on the basis of a desired compression volume ratio in the previous stage.

Patent Document 1: Japanese Patent Application Publication No. 2008-88879

In a multistage vacuum pump, the rotors are typically fixed by key grooves or the like formed in the shafts. In this case, to prioritize ease of manufacture, the male rotors and the female rotors of all stages are disposed alternately either coaxially and at identical angles or simply at identical angles so that no phase differences occur between the respective stages.

However, gas is pumped between the respective stages at an identical timing in all of the stages, leading to increases in pulsation and power variation. Accordingly, noise and vibration increase, and it becomes necessary to provide a large power supply capable of absorbing a power variation peak. As a result, an increase in cost occurs.

DISCLOSURE OF THE INVENTION

The present invention has therefore been designed in consideration of these problems in the related art, and an object thereof is to provide a multistage vacuum pump that can maintain high compression efficiency while suppressing pulsation and power variation.

To solve the problems described above, a multistage vacuum pump according to the present invention is a multistage vacuum pump in which a plurality of pump chambers are formed by a housing and a partition plate, the plurality of pump chambers are connected via a gas passage formed in the partition plate, a pair of rotors attached to a shaft are disposed in each of the pump chambers, and when the pair of rotors rotate while intermeshing, a suctioned gas is compressed and then discharged through a discharge side recessed portion that communicates with the gas passage, wherein angles of the rotors relative to the shaft are adjusted such that a phase angle $\Delta\theta$ of the rotor angle in adjacent pump chambers relative to a rotation angle C of the rotors during a single cycle of the pump chambers from intake to discharge and the number of stages S of the rotors satisfies $\Delta\theta \leqq C/S$, and when a rotor angle $\phi$ from a reference position to an opening start point of the discharge side recessed portion is set as a first stage rotor angle $\phi 1$, an mth stage rotor angle $\phi m$, and an nth stage rotor angle $\phi n$ in order from an upstream side of a gas flow direction, relationships of $\phi 1 \leqq \phi m \leqq \phi n$ and $\phi 1 < \phi n$ (where n and m are natural numbers and $n > m$) are satisfied. At this time, the rotor angle $\phi m$ preferably satisfies $\phi m \leqq \phi m+1$.

By setting the rotor phase angle $\Delta\theta$ at $\Delta\theta \leqq C/S$ in this manner, discharge timings in the respective stages can be staggered. More specifically, when the discharge timings of the plurality of pump chambers are simultaneous, increases occur in pulsation and a power variation peak, but by staggering the discharge timings, as in the present invention, noise and vibration generated by the vacuum pump can be suppressed. Further, by setting the rotor angle $\phi$ from the reference position to the opening start point of the discharge side recessed portion to satisfy $\phi 1 \leqq \phi m \leqq \phi n$ and $\phi 1 < \phi n$, the discharge timing of a subsequent stage side pump chamber can be delayed relative to that of a previous stage side such that the subsequent stage side pump chamber exhibits a higher compression ratio, and as a result, a compression efficiency of the vacuum pump can be maintained at a high level.

Further, the shaft and the rotor are preferably fixed by a fixing unit, and the fixing unit preferably includes: a ring-shaped cutout portion formed in a shaft penetration portion of the rotor; an inside ring that is inserted into the cutout portion and formed in a tapered shape such that an inner peripheral surface thereof contacts the shaft and an outer peripheral surface thereof increases in diameter toward a back side of the cutout portion; an outside ring that is inserted into the cutout portion so as to contact the inside ring and formed in a tapered shape such that an outer peripheral surface thereof contacts the rotor and an inner peripheral surface thereof increases in diameter toward the back side of the cutout portion; and a pressing member that presses the outside ring from an open side of the cutout portion toward the back side of the cutout portion.

By attaching the rotor and the shaft by pressure using the tapered inside and outside rings in this manner, the rotor and the shaft can be fixed without implementing cutting processing on the shaft. Further, a shaft circumference direction position of the rotor can be adjusted freely when assembling the rotor and the shaft.

Furthermore, the shaft and the rotor are preferably fixed by a fixing unit, the fixing unit preferably includes a key groove formed in the shaft and a projecting portion formed on the rotor in order to engage with the key groove, and the key groove is preferably formed in a plurality in different circumferential direction positions of the shaft in accordance with the phase angle of the rotor.

By engaging the rotor and the shaft via the key groove in this manner, the angle of the rotor can be set precisely and reliably prevented from shifting.

Moreover, the shaft and the rotor are preferably fixed by a fixing unit, and the fixing unit preferably includes a spline groove formed in the shaft and a projecting portion formed on the rotor in order to engage with the spline groove.

By engaging the shaft and the rotor via a spline engagement in this manner, the angle of the rotor can be adjusted easily and reliably prevented from shifting.

Further, the multistage vacuum pump described above is preferably a claw type vacuum pump. Thus, noise and vibration can be suppressed greatly even in a claw type vacuum pump in which pulsation and power variation are likely to occur.

According to the present invention described above, the discharge timings at the respective stages can be staggered by setting the rotor phase angle $\Delta\theta$ at $\Delta\theta \leqq C/S$. More specifically, when the discharge timings of the plurality of pump chambers are simultaneous, increases occur in pulsation and the power variation peak, but by staggering the discharge timings, as in the present invention, noise and vibration generated by the vacuum pump can be suppressed.

Further, by setting the rotor angle $\phi$ from the reference position to the opening start point of the discharge side recessed portion to satisfy $\phi 1 \leqq \phi m \leqq \phi n$ and $\phi 1 < \phi n$, the discharge timing of the subsequent stage side pump chamber can be delayed relative to that of the previous stage side such that the subsequent stage side pump chamber exhibits a higher compression ratio, and as a result, the compression efficiency of the vacuum pump can be maintained at a high level.

BRIEF DESCRIPTION OF THE DRAWINGS

FIG. 1 is a view showing an overall configuration of a multistage vacuum pump according to an embodiment of the present invention, wherein FIG. 1A is an exploded perspective view and FIG. 1B is an internal structural view;

FIG. 2 is a view showing an outer form of the multistage vacuum pump according to this embodiment of the present invention, wherein FIG. 2A is a side view and FIG. 2B is a perspective view;

FIG. 3 is a view showing a rotor attached to a shaft, wherein FIG. 3A is a perspective view and FIG. 3B is a side view;

FIG. 4 is a view showing a discharge side partition plate, wherein FIG. 4A is a plan view, FIG. 4B is a side view, and FIG. 4C is a perspective view;

FIG. 5 is a view showing an intake side partition plate, wherein FIG. 5A is a plan view and FIG. 5B is a perspective view;

FIG. 8 is a view showing a fixing unit including a key groove, wherein FIG. 8A is a front view of the rotor, FIG. 8B is a sectional view of the shaft, and FIG. 8C is a perspective view of the shaft;

BEST MODE FOR CARRYING OUT THE INVENTION

A preferred embodiment of the present invention will be described in detail below as an example, with reference to the drawings. Note, however, that unless specific description is provided to the contrary, dimensions, materials, shapes, relative arrangements, and so on of constitutional components described in this embodiment are not intended to limit the scope of the present invention, and are merely descriptive examples. Also note that in the embodiment to be described below, a claw type vacuum pump, to which the present invention may be applied favorably, will be described as an example.

First, referring to FIGS. 1 and 2, an overall configuration of a multistage vacuum pump will be described.

Figure 1:
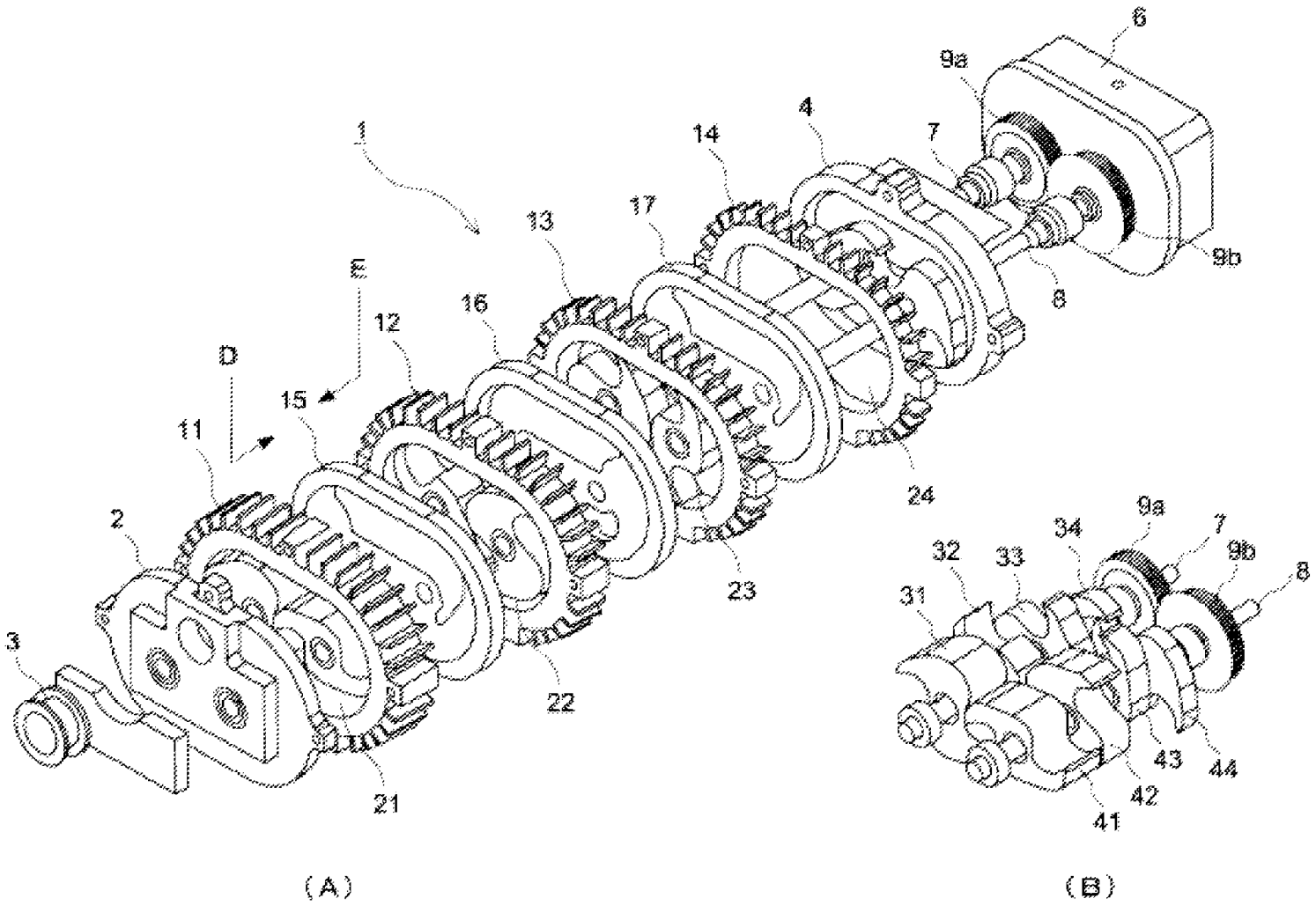
Figure 2:
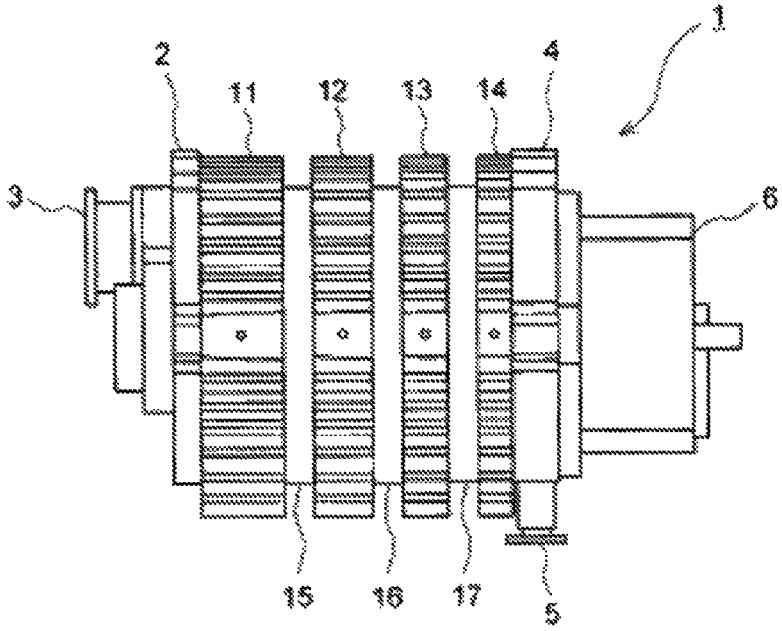
Figure 2:
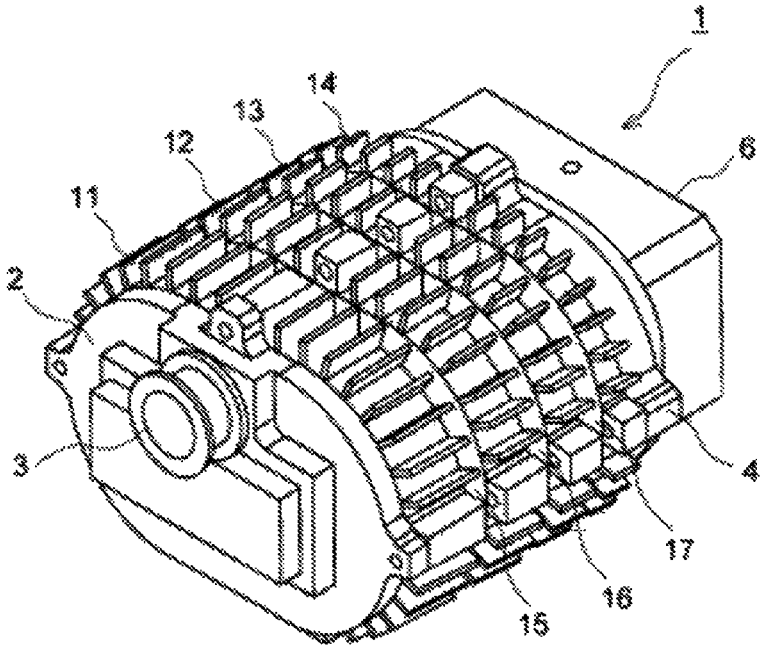

FIG. 1 is a view showing an overall configuration of a multistage vacuum pump according to an embodiment of the present invention, wherein FIG. 1A is an exploded perspective view and FIG. 1B is an internal structural view. FIG. 2 is a view showing an outer form of the multistage vacuum pump according to this embodiment of the present invention, wherein FIG. 2A is a side view and FIG. 2B is a perspective view.

A multistage vacuum pump 1 according to this embodiment mainly includes housings 11 to 14, a side cover 2 disposed on an intake side of the housing 11, a side cover 4 disposed on a discharge side of the housing 14, a motor 6, shafts 7, 8 that are driven to rotate by the motor 6, partition plates 15 to 17, and rotors 31 to 34 and rotors 41 to 42 attached respectively to the shafts 7, 8.

The housings 11 to 14 accommodate the shafts 7, 8, the rotors 31 to 34, and the rotors 41 to 42. The housings 11, 12, 13, 14 are disposed in an axial direction in sequence from an upstream side of a gas flow direction. The side cover 2 and the side cover 4 are disposed respectively on the intake side and the discharge side of the housings 11 to 14, and the partition plates 15 to 17 are interposed between the housings 11 to 14.

The partition plates 15 to 17 are disposed perpendicular to the shafts 7, 8, and the respective partition plates 15 to 17 are disposed in parallel in the axial direction. Note that in this example, the housings 11 to 14 and the partition plates 15 to 17 are provided separately, but the housings 11 to 14 and the partition plates 15 to 17 may be formed integrally for each stage.

In order from the upstream side, a first stage pump chamber 21 is formed by the side cover 2, the housing 11, and the partition plate 15, a second stage pump chamber 22 is formed by the partition plate 15, the housing 12, and the partition plate 16, a third stage pump chamber 23 is formed by the partition plate 16, the housing 13, and the partition plate 17, and a fourth stage pump chamber 24 is formed by the partition plate 17, the housing 14, and the side cover 4.

A gas suction port 3 is provided in the side cover 2 on the intake side, and a discharge port 5 is provided in the side cover 4 on the discharge side. A gas passage 28 (see FIGS. 4 and 5) that connects the adjacent pump chambers 21 to 24 is provided in the partition plates 15 to 17.

Gas suctioned through the gas suction port 3 is compressed in the pump chambers 21 to 24 of the respective stages by a rotor rotation operation, to be described in detail below, and then discharged through the discharge port 5.

The rotors 31 to 34, which are rotated by the shaft 7, and the rotors 41 to 44, which are rotated by the shaft 8, are accommodated in the pump chambers 21 to 24 of the respective stages.

The two shafts 7, 8 are disposed in parallel. The shafts 7, 8 are respectively coupled to the motor 6 and driven to rotate by the motor 6. At this time, respective rotation timings of the shaft 7 and the shaft 8 are synchronized by gears 9*a*, 9*b* provided on respective end portions of the shafts 7, 8.

Figure 3:
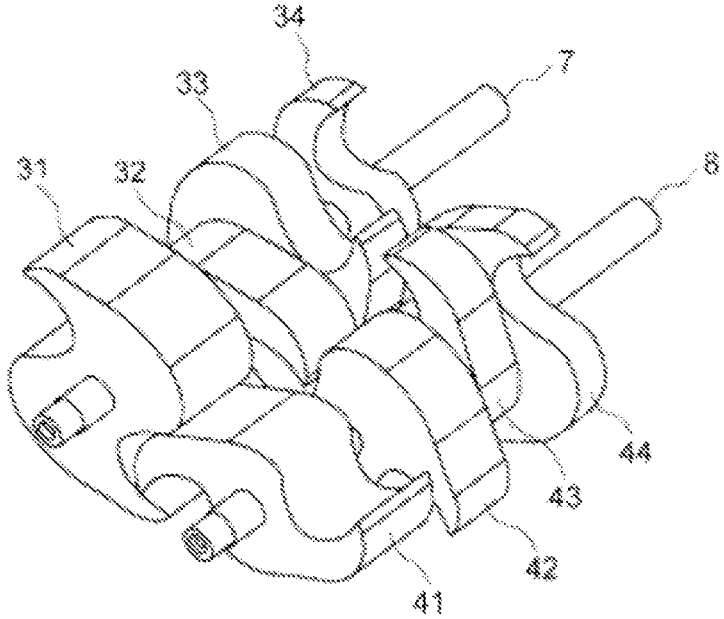
Figure 3:
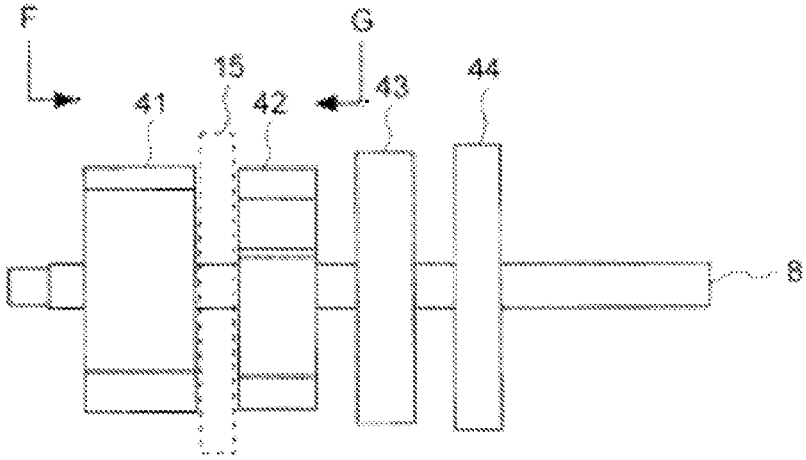
Figure 4:
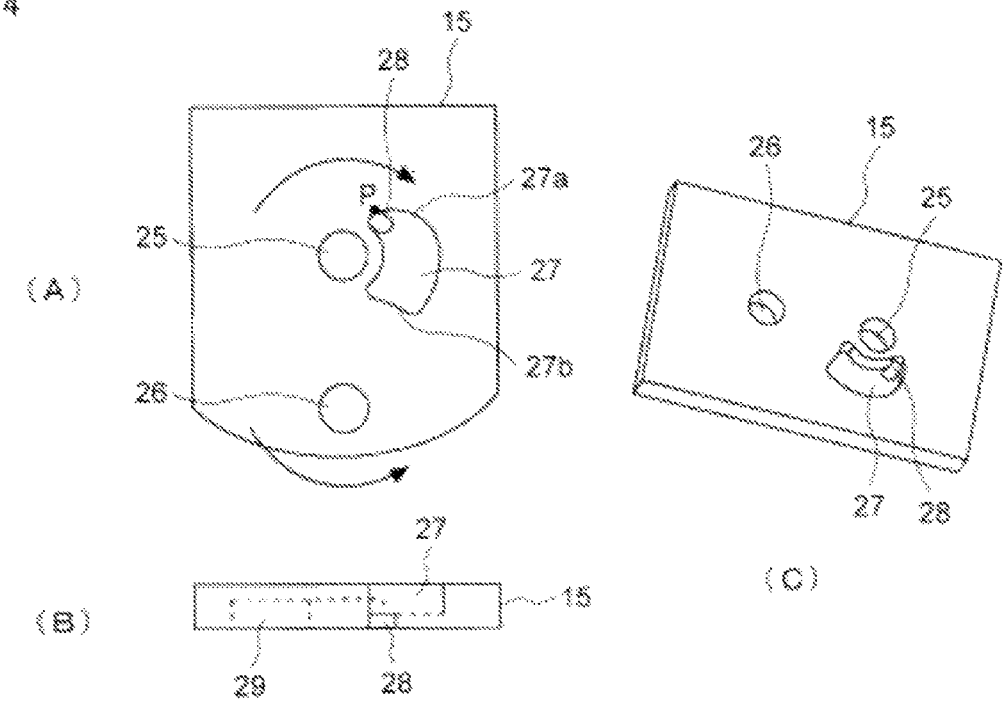
Figure 5:
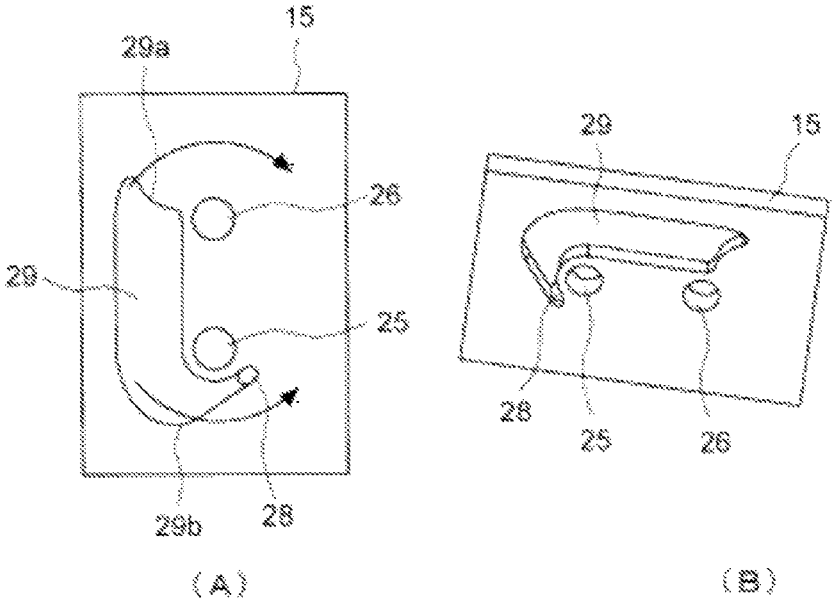

Referring to FIGS. 3 to 5, the internal structure of the multistage vacuum pump will be described.

FIG. 3 is a view showing a rotor attached to a shaft, wherein FIG. 3A is a perspective view and FIG. 3B is a side view. FIG. 4 is a view showing a discharge side partition plate, wherein FIG. 4A is a plan view, FIG. 4B is a side view, and FIG. 4C is a perspective view. FIG. 5 is a view showing an intake side partition plate, wherein FIG. 5A is a plan view and FIG. 5B is a perspective view.

As shown in FIGS. 3A and 3B, the rotors 31 to 34 attached to the shaft 7 and the rotors 41 and 44 attached to the shaft 8 form rotor sets constituted by respective pairs of female rotors and male rotors. For example, the female rotor 31 and the male rotor 41 intermesh with each other while maintaining a slight gap and rotate in opposite directions. In the example shown in FIG. 3, the female rotors and the male rotors are disposed alternately in the axial direction of the shafts 7, 8, but either the male rotors or the female rotors may be disposed coaxially.

Note that the rotors 31 to 34 and the rotors 41 to 44 may have identical thicknesses or steadily decreasing thicknesses from an upper stage side toward a lower stage side, as shown in the drawings.

Further, in FIG. 3, the rotors are shaped such that two compression processes are performed in a single cycle, but the rotor shape is not limited thereto, and a rotor shape with which a single compression process is performed in a single cycle, a rotor shape with which three compression processes are performed in a single cycle, and so on may be used instead.

FIG. 4A is a view seen from the direction of an arrow D in FIG. 1, or in other words a plan view showing a discharge side surface of the partition plate 15 from a D direction. FIG. 4B is a side view showing the discharge side surface of the partition plate 15 from above, and FIG. 4C is a perspective view.

As shown in these drawings, the discharge side surface of the partition plate 15 is provided with a shaft penetration portion 25 that is penetrated by the shaft 7 to which the female rotor 31 is attached, a shaft penetration portion 26 that is penetrated by the shaft 8 to which the male rotor 41 is attached, a discharge side recessed portion 27 formed in a curved shape around an outer periphery of the female rotor 31 side shaft penetration portion 25, and the gas passage 28 that penetrates the partition plate 15 so as to communicate with the discharge side recessed portion 27. Positions and shapes of an edge 27*a* and an edge 27*b* of the discharge side recessed portion 27 are determined by an outer diameter and a phase angle of a previous stage rotor. Further, arrows in the drawing indicate rotation directions of the rotors 31, 41 (not shown), while the discharge side recessed portion 27 is opened from an opening start point P.

FIG. 5A is a view seen from the direction of an arrow E in FIG. 1, or in other words a plan view showing an intake side surface of the partition plate 15 from an E direction. FIG. 5B is a perspective view showing the intake side surface of the partition plate 15 from below.

As shown in these drawings, the intake side surface of the partition plate 15 is provided with the shaft penetration portion 25 penetrated by the shaft 7 and the shaft penetration portion 26 penetrated by the shaft 8, similarly to FIG. 4, as well as an intake side recessed portion 29 that curves around the outer periphery of the shaft penetration portion 25 and extends to the shaft penetration portion 26 side and the gas passage 28 that penetrates the partition plate 15 so as to communicate with the intake side recessed portion 29. Positions and shapes of an edge 29*a* and an edge 29*b* of the intake side recessed portion 29 are determined by an outer diameter and a phase angle of a subsequent stage rotor. Further, arrows in the drawing indicate rotation directions of the rotors 32, 42 (not shown).

Note that the partition plates 16, 17 are configured similarly to the partition plate 15 shown in FIGS. 4 and 5, and therefore description thereof has been omitted.

Next, a featured configuration of the vacuum pump according to this embodiment of the present invention will be described. In the vacuum pump 1 configured as described above, respective angles of the rotors relative to the shafts are adjusted such that a phase angle $\Delta\theta$ of the rotors relative to a rotation angle C of the rotors during a single cycle of the pump chambers 21 to 24 from intake to discharge and a number of stages S of the rotors in the axial direction satisfies Equation (1) below, $$\Delta\theta \leqq C/S \tag{1}$$

and when a rotor angle $\phi$ from a reference position to the opening start point of the discharge side recessed portion is set as a first stage rotor angle $\phi 1$, an mth stage rotor angle $\phi m$, and an nth stage rotor angle $\phi n$ in sequence from the upstream side of the gas flow direction, $\phi 1$, $\phi m$, and $\phi n$ satisfy Equation (2) and Equation (3) below, $$\phi 1 \leqq \phi m \leqq \phi n \tag{2}$$

$$\phi 1 < \phi n \tag{3}$$

where n and m are natural numbers and n>m. Further, $\Delta\theta$ is the phase angle of the rotors of adjacent pump chambers. Furthermore, the rotor angle $\phi$ represents the rotor angle $\phi$ when the discharge side recessed portion 27 shown in FIG. 4 opens, or more specifically the rotation angle of the rotor following rotation from an arbitrary reference position to the opening start point P of the discharge side recessed portion 27.

Setting is preferably performed such that Equation (4) below is also satisfied, $$\phi m \leqq \phi m+1 \tag{4}$$

where n and m are natural numbers and n>m+1.

By setting the rotor phase angle at $\Delta\theta \leqq C/S$ in this manner, discharge timings of the respective stages can be staggered, and as a result, noise and vibration generated by the vacuum pump can be suppressed.

Further, by setting the rotor angle $\phi$ from the reference position to the opening start point of the discharge side recessed portion to satisfy $\phi 1 \leqq \phi m \leqq \phi n$ and $\phi 1 < \phi n$, the discharge timing of a subsequent stage side pump chamber can be delayed relative to that of a previous stage side such that the subsequent stage side pump chamber exhibits a higher compression ratio, and as a result, a compression efficiency of the vacuum pump can be maintained at a high level.

Figure 6:
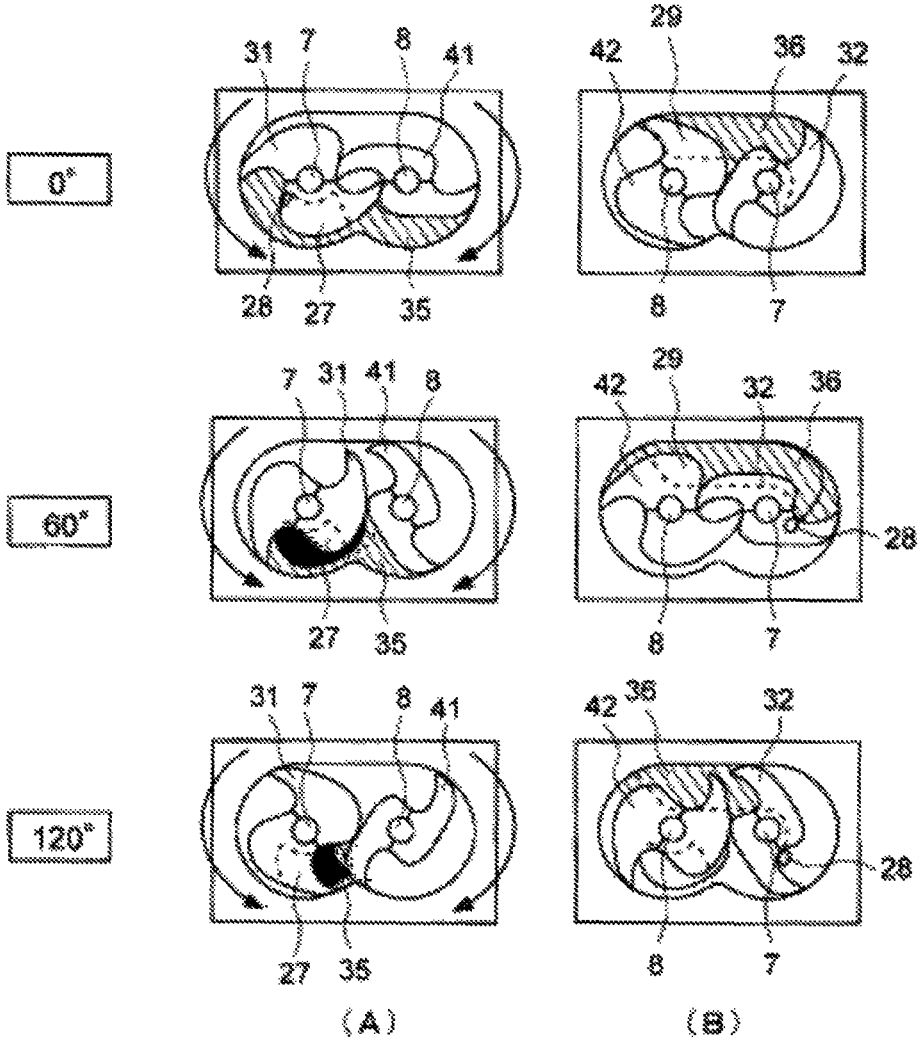
FIG. 6 is a view illustrating intake, compression, and discharge processes of a pump chamber.

Referring to FIG. 6, an intake process and a discharge process of the vacuum pump 1 configured as described above will now be described.

FIG. 6 is a view illustrating intake, compression, and discharge processes of a conventional multistage vacuum pump. FIG. 6A is a view illustrating the compression and discharge processes from the direction of an arrow F in FIG. 3B, and FIG. 6B is a view illustrating the intake process from the direction of an arrow G in FIG. 3B. The discharge process of FIG. 6A and the intake process of FIG. 6B are illustrated in accordance with the rotor rotation angle.

In the discharge process shown in FIG. 6A, when the rotation angle of the rotors 31, 41 is 0°, a compression pocket 35 (a shaded region of the drawing) is closed, and therefore the gas is compressed as the female rotor 31 and the male rotor 41 rotate.

When the rotation angle of the rotors 31, 41 is 60°, the discharge side recessed portion 27 opens onto the compression pocket 35, whereby discharge begins. When the rotation angle of the rotors 31, 41 is 120°, the discharge side recessed portion 27 and the compression pocket 35 remain in a communicative condition, and therefore discharge continues.

In the intake process shown in FIG. 6B, when the rotation angle of the rotors 32, 42 is 0°, an intake pocket 36 (a shaded region of the drawing) is open to the intake side recessed portion 29, and likewise when the rotation angle of the rotors 32, 42 is 60° and 120°, the intake pocket 36 and the intake side recessed portion 29 remain communicative.

A fixing unit which fixes the shafts and the rotors in the vacuum pump configured as described above will now be described.

Figure 7:
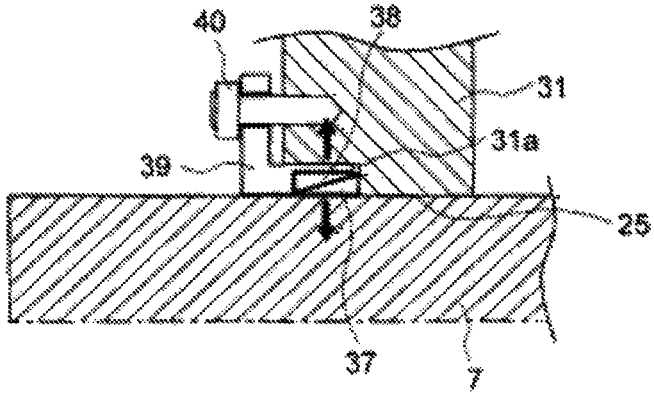
FIG. 7 is a side view showing a fixing unit including a tapered ring.

FIG. 7 is a side view showing a fixing unit that fixes the shaft 7 and the rotor 31. Here, a ring-shaped cutout portion 31*a* is provided in the shaft penetration portion 25 of the rotor 31, and an inside ring 37 that contacts the shaft 7 and an outside ring 38 that contacts an outer peripheral surface of the inside ring 37 are inserted into the cutout portion 31*a*. An inner surface of the inside ring 37 has a tapered shape that contacts an outer peripheral surface of the shaft 7 and increases in diameter toward an axial direction back side of the cutout portion 31*a*. An inner surface of the outside ring 38 has a tapered shape that contacts the outer surface of the inside ring 37 and increases in diameter toward the axial direction back side of the cutout portion 31*a*.

The outside ring 38 is pressed toward the axial direction back side by a pressing member 39 that contacts the outside ring 38 from an open side of the cutout portion 31*a*, and a flange portion of the pressing member 39 is fixed to the rotor 31 by a fastening member 40. Accordingly, a pressing force is applied in the directions of arrows in the drawing, and as a result, the rotor 31 and the shaft 7 are attached by pressure.

By attaching the rotor 31 and the shaft 7 by pressure using the tapered rings 37, 38 in this manner, the rotor 31 and the shaft 7 can be fixed without implementing cutting processing on the shaft 7. Further, a shaft circumference direction position of the rotor 31 can be adjusted freely when assembling the rotor 31 and the shaft 7.

Figure 8:
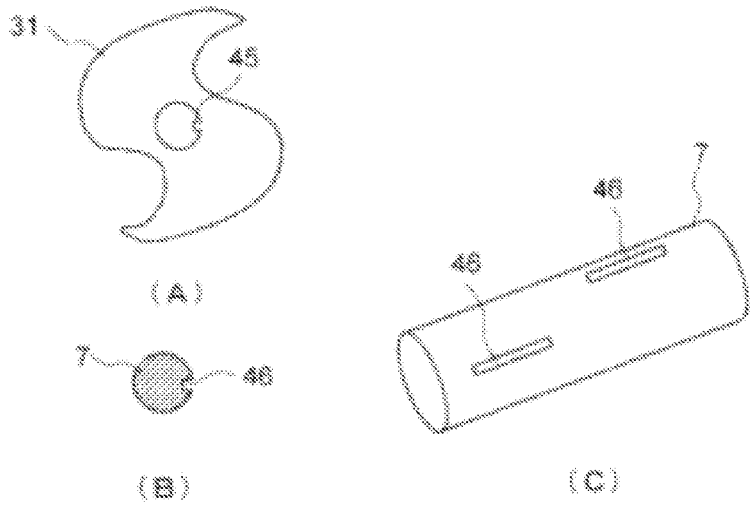

In another example of a fixing unit for fixing the shaft 7 and the rotor 31, a structure employing a key groove 46, such as that shown in FIG. 8, may be employed. FIG. 8A is a sectional view of the rotor, FIG. 8B is a sectional view of the shaft, and FIG. 8C is a perspective view of the shaft.

As shown in FIG. 8A, a rectilinear projecting portion 45 is formed on the rotor 31 in the axial direction. As shown in FIGS. 8B and 8C, meanwhile, a key groove 46 cut into a rectilinear shape is formed in the shaft 7 in the axial direction. The key groove 46 is formed in a plurality in different circumferential direction positions of the shaft 7 in accordance with the phase angle of the rotor 31.

By engaging the rotor 31 and the shaft 7 via the key groove 46, the angle of the rotor 31 can be set precisely and reliably prevented from shifting.

Figure 9:
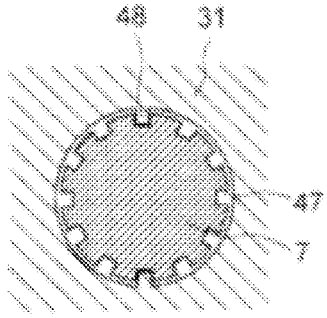
FIG. 9 is a sectional view showing a fixing unit including a spline groove.
Figure 10:
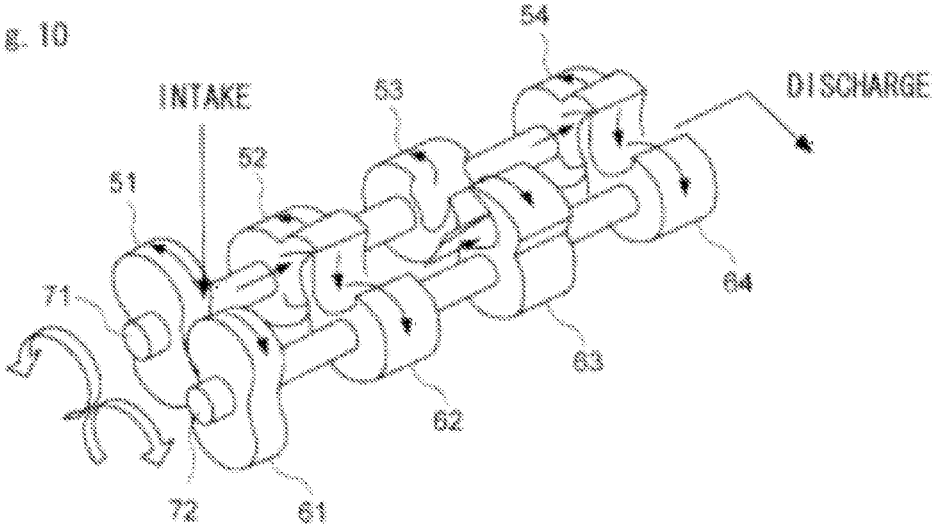
FIG. 10 is a perspective view showing an internal structure of a conventional multistage vacuum pump.
Figure 11:
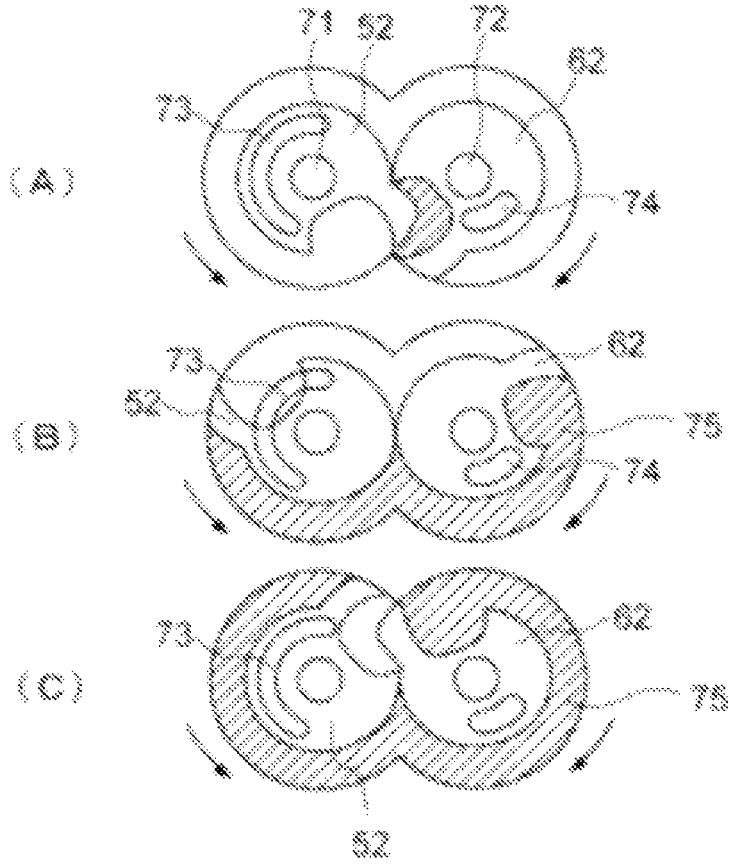
FIG. 11 is a view illustrating intake, compression, and discharge processes of the conventional multistage vacuum pump.

In a further example of a fixing unit for fixing the shaft 7 and the rotor 31, the shaft 7 and the rotor 31 may be spline-engaged, as shown in FIG. 9. FIG. 9 is a sectional view of the shaft to which the rotor is attached.

As shown in FIG. 9, a spline groove 47 is formed in the outer peripheral surface of the shaft 7 to be parallel to the axial direction, and one or a plurality of rectilinear projecting portions 48 is formed on an inner surface of the shaft penetration portion 25 of the rotor 31 in accordance with the spline groove 47. By engaging the spline groove 47 of the shaft 7 with the projecting portion 48 of the rotor 31, the rotor 31 can be fixed in the circumferential direction of the shaft 7. Further, the angle of the rotor 31 can be adjusted easily and reliably prevented from shifting.

The invention claimed is:

1. A multistage vacuum pump in which a plurality of pump chambers are formed by a housing and a partition plate, the plurality of pump chambers are connected via a gas passage formed in the partition plate, a pair of rotors attached to a shaft are disposed in each of the pump chambers, and when the pair of rotors rotate while intermeshing, a suctioned gas is compressed and then discharged through a discharge side recessed portion that communicates with the gas passage, the multistage vacuum pump being characterized in that angles of the rotors relative to the shaft are adjusted such that a phase angle $\Delta\theta$ of the rotors of adjacent pump chambers relative to a rotation angle C of the rotors during a single cycle of the pump chambers from intake to discharge and the number of stages S of the rotors satisfies $\Delta\theta \leqq C/S$, and when a rotor angle $\phi$ from a reference position to an opening start point of the discharge side recessed portion is set as a first stage rotor angle $\phi 1$, an mth stage rotor angle $\phi m$, and an nth stage rotor angle $\phi n$ in order from an upstream side of a gas flow direction, relationships of $\phi 1 \leqq \phi m \leqq n$ and $\phi 1 < \phi n$ (where n and m are natural numbers and n>m) are satisfied.

2. The multistage vacuum pump according to claim 1, characterized in that the rotor angle $\phi m$ satisfies $\phi m \leqq \phi m+1$.

3. The multistage vacuum pump according to claim 1, characterized in that the shaft and the rotor are fixed by a fixing unit, and the fixing unit has:

a ring-shaped cutout portion formed in a shaft penetration portion of the rotor;

an inside ring that is inserted into the cutout portion and formed in a tapered shape such that an inner peripheral surface thereof contacts the shaft and an outer peripheral surface thereof increases in diameter toward a back side of the cutout portion;

an outside ring that is inserted into the cutout portion so as to contact the inside ring and formed in a tapered shape such that an outer peripheral surface thereof contacts the rotor and an inner peripheral surface thereof increases in diameter toward the back side of the cutout portion; and a pressing member that presses the outside ring from an open side of the cutout portion toward the back side of the cutout portion.

4. The multistage vacuum pump according to claim 1, characterized in that the shaft and the rotor are fixed by a fixing unit, the fixing unit has a key groove formed in the shaft and a projecting portion formed on the rotor in order to engage with the key groove, and the key groove is formed in a plurality in different circumferential direction positions of the shaft in accordance with the phase angle of the rotor.

5. The multistage vacuum pump according to claim 1, characterized in that the shaft and the rotor are fixed by a fixing unit, and the fixing unit has a spline groove formed in the shaft and a projecting portion formed on the rotor in order to engage with the spline groove.

6. The multistage vacuum pump according to claim 1, characterized in that the multistage vacuum pump is a claw type vacuum pump.

* * * * *